US007284451B2

(12) United States Patent
Cupif et al.

(10) Patent No.: US 7,284,451 B2
(45) Date of Patent: Oct. 23, 2007

(54) DYNAMOMETER TOOL, IN PARTICULAR A TORQUE WRENCH, AND A METHOD OF DETECTING A BREAK IN MECHANICAL EQUILIBRIUM DURING TIGHTENING TO TORQUE

(75) Inventors: Bertrand Cupif, Antony (FR); Philippe Praudel, Longjumeau (FR); Jocelyn Vecchio, Vitry sur Seine (FR)

(73) Assignee: Facom, Morangis (FR)

( * ) Notice: Subject to any disclaimer, the term of this patent is extended or adjusted under 35 U.S.C. 154(b) by 0 days.

(21) Appl. No.: 11/101,455

(22) Filed: Apr. 8, 2005

(65) Prior Publication Data

US 2005/0223817 A1 Oct. 13, 2005

(30) Foreign Application Priority Data

Apr. 9, 2004 (FR) ..... 04 03722
Apr. 9, 2004 (FR) ..... 04 03724

(51) Int. Cl.
*B25B 23/14* (2006.01)
*B25B 23/144* (2006.01)
*B25B 23/159* (2006.01)

(52) U.S. Cl. ..... 73/862.23; 73/862.21; 81/479

(58) Field of Classification Search ..... 73/862.23, 73/862.21; 81/479
See application file for complete search history.

(56) References Cited

U.S. PATENT DOCUMENTS 3,982,419 A 9/1976 Boys
4,110,829 A 8/1978 Boys
4,319,494 A * 3/1982 Marcinkiewicz ..... 73/862.23
4,426,887 A 1/1984 Reinholm et al.
4,450,727 A 5/1984 Reinholm et al.
4,562,746 A 1/1986 Petit
5,129,293 A * 7/1992 Larson et al. ..... 81/483
6,119,562 A 9/2000 Jenkins
6,138,539 A 10/2000 Carchidi et al.
6,234,051 B1 * 5/2001 Bareggi ..... 81/479
6,276,243 B1 8/2001 Jenkins
6,405,598 B1 6/2002 Bareggi
2003/0094081 A1 * 5/2003 Becker et al. ..... 81/479
2004/0003683 A1 1/2004 Rudduck

FOREIGN PATENT DOCUMENTS

DE 10226134 A1 12/2003
EP 1068931 A2 1/2001
EP 1038638 A1 9/2001
FR 2842449 1/2004

OTHER PUBLICATIONS

Patent Abstracts of Japan, vol. 1996, No. 09, Sep. 30, 1996 & JP 8 118251 A (Tonichi Seisakusho: KK), May 14, 1996.

* cited by examiner

*Primary Examiner*—Edward Lefkowitz
*Assistant Examiner*—Punam Patel
(74) *Attorney, Agent, or Firm*—Wenderoth, Lind & Ponack, L.L.P.

(57) ABSTRACT

A means for detecting a break in mechanical equilibrium comprised of a measurement means that delivers a signal corresponding to a measurement of a torque applied to a fastener element, an electronic processing means for electronically processing a signal, and a computation processing means for computationally processing data output from the electronically processing of the signal. Application to a hand dynamometer tool.

6 Claims, 7 Drawing Sheets

DYNAMOMETER TOOL, IN PARTICULAR A TORQUE WRENCH, AND A METHOD OF DETECTING A BREAK IN MECHANICAL EQUILIBRIUM DURING TIGHTENING TO TORQUE

BACKGROUND OF THE INVENTION

The present invention relates to a mechanical dynamometer tool, in particular a torque wrench, for manually applying torque, more specifically the dynamometer tool includes a mechanical means suitable for delivering predetermined torsion torque to a drive portion designed to co-operate with a tightening drive member for driving a fastener element, the mechanical means being in mechanical equilibrium under the action of suitable bias means, the mechanical means being releasable by breaking the mechanical equilibrium, and means for detecting a break in mechanical equilibrium.

It is known that operations for tightening fastener elements in industrial environments require increasing levels of traceability, i.e. knowledge of all of the information and of the measures that make it possible to monitor and to reconstruct rapidly the steps of the process.

For tightening operations, dynamometer tool manufacturers propose mechanical tools whose principle is based on equilibrium breaking in a manner that is very perceptible, making it possible for the break in equilibrium to be detected by a device having an electrical circuit provided with switch means whose state is changed by the break in equilibrium, and with a processing unit adapted to use the information relating to the state of said switch means. The entire detection device is generally housed in a housing fastened to the outside of the body of the tool.

Such a construction is not entirely satisfactory because the housing defines a protuberance on the periphery of the body of the tool, which protuberance is potentially a hindrance to inserting the tool into a mechanical member on which the operator is acting.

In addition, such a construction uses a miniature switch whose life is relatively short and that poses problems of reliability when it is subjected to sudden actuation, which generally applies for tools operating by breaking mechanical equilibrium.

Known devices also suffer from the drawback of not taking account of the phenomenon of over-torque that is exerted during the operation of tightening to torque once the equilibrium is broken. The value of such over-torque can be as high as 50% of the predetermined set torque when the wrench is used under certain conditions.

In addition, the use of electronic dynamometer wrenches is not desired on assembly lines because, with such wrenches, no physical sensation of going beyond the tightening torque can be felt.

SUMMARY OF THE INVENTION

A main object is to remedy those drawbacks and to provide a mechanical dynamometer tool whose compactness is not reduced and whose reliability is increased.

Another object is to provide a mechanical dynamometer tool that makes it possible to improve the traceability of the tightening-to-torque operations, by taking account of the phenomenon of over-torque.

To these ends, in a mechanical dynamometer tool of the invention, the means for detecting a break in mechanical equilibrium comprise measurement means delivering a signal corresponding to the measurement of the torque applied to the fastener element, electronic processing means for electronically processing said signal, and computation processing means for computationally processing data output from the electronic processing of said signal.

Below are other characteristics of the invention.

- The computation means detects the break in mechanical equilibrium by computing the derivative of the measured value of the torque as a function of time.
- The computation means detects the break in mechanical equilibrium by computing the intersection of a first curve and of a second curve, the first curve representing the measured value of the torque as a function of time, and the second curve being identical to the first curve with a small, positive offset in time.
- The electronic processing means for electronically processing the signal and the computation means are disposed inside the wrench.
- The wrench further comprises transmission means for transmitting the measurement of the maximum tightening torque applied to the fastener element to a station external to the tool, and the station displays the value of the maximum tightening torque applied to the fastener element.
- The wrench further comprises transmission means for transmitting the maximum tightening torque applied to the fastener element to reception means that are secured to the tool, and the reception means display information corresponding to the value of the maximum tightening torque applied to the fastener element.
- The measurement means comprise resistive sensor elements.
- The measurement means comprise a plurality of strain gauges connected in a bridge circuit.
- The dynamometer tool is a torque setting or disengagement wrench.
- The dynamometer tool is a break back torque wrench.
- The dynamometer tool is a screwdriver.
- The information is transmitted by radio.
- The bias means comprise a spring whose compression determines the set torque, the spring participating in the axial bearing force that bears against the mechanical means. The measurement means constituted by sensor elements of measurement members, such as resistive extensometers or strain gauges, delivers information corresponding to the measurement of the torque applied to the fastener element. An electronic processing unit, integrated into the tool, delivers information corresponding to the measurement of the maximum torque applied to the fastener element after the mechanical equilibrium is broken, and transmits to a reception unit the information corresponding to the measurement of the maximum torque applied to the fastener element after the mechanical equilibrium is broken.
- The processing unit is disposed internally to the wrench.
- The reception unit is an external station that is external to the tool, and it displays the value of the measurement of the maximum tightening torque applied to the fastener element.
- The reception unit is secured to the tool, and it displays the value of the measurement of the maximum tightening torque applied to the fastener element.

The invention also provides a method of detecting a break in mechanical equilibrium during manual tightening to torque a fastener element when the applied torque reaches a predetermined set torque. The method comprising the following steps.

Delivering information corresponding to the measurement of the torque applied to the fastener element.

Electronically processing said information.

Computationally processing digital data output from the electronic processing of said information.

Finally, the invention provides a method of manually tightening to torque a fastener element by using the principle of mechanical equilibrium being broken when the applied torque reaches a predetermined set torque. The method comprising the following steps.

Delivering information corresponding to the measurement of the torque applied to the fastener element.

Electronically processing and delivering information corresponding to the measurement of the maximum torque applied after a break in mechanical equilibrium.

Transmitting the information corresponding to the measurement of the maximum torque applied after a break in mechanical equilibrium.

BRIEF DESCRIPTION OF THE DRAWINGS

A particular embodiment of the invention is described in more detail below with reference to the accompanying drawings, in which.

DETAILED DESCRIPTION OF THE INVENTION

Figure 1:
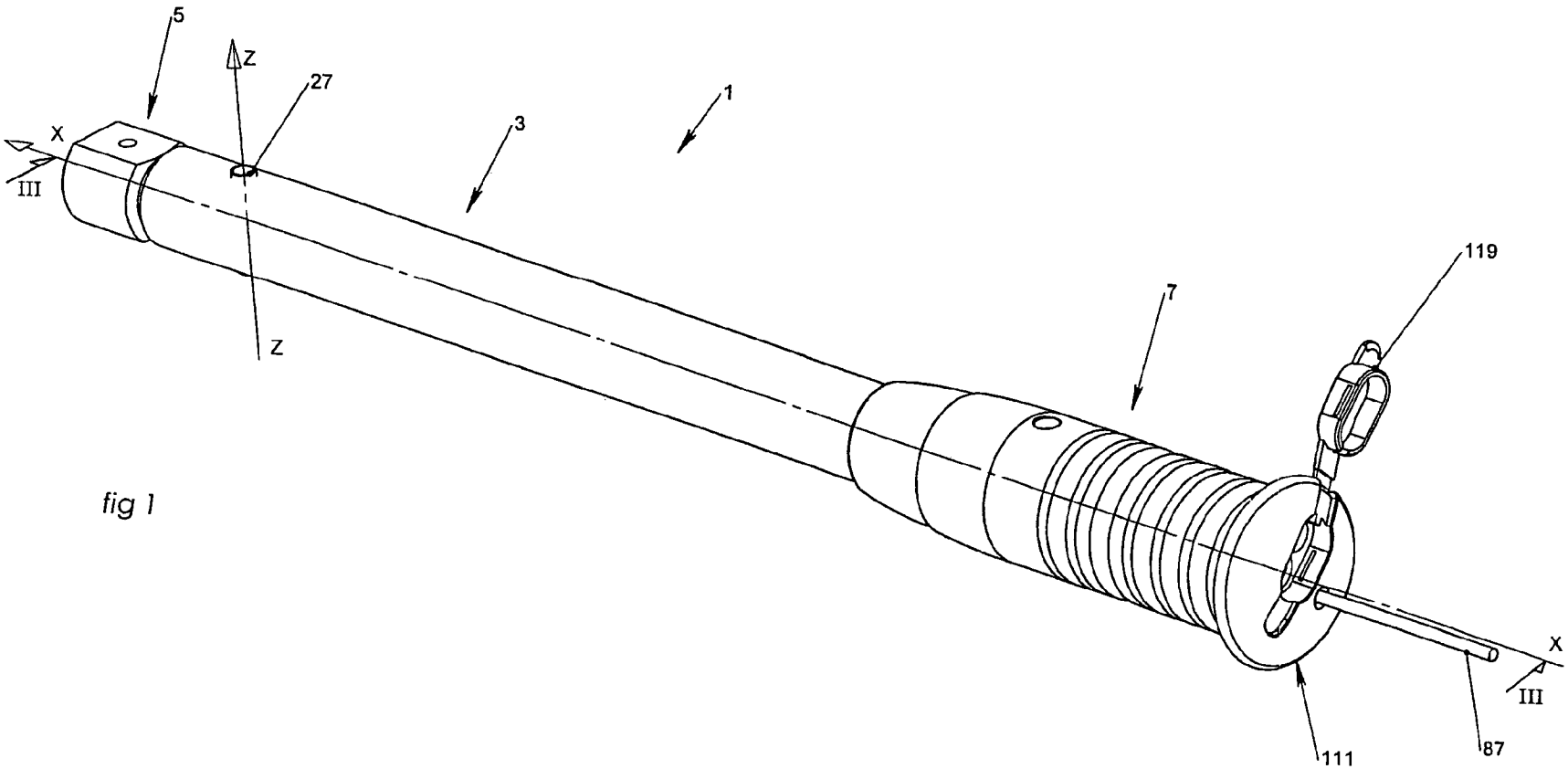
FIG. 1 is a perspective view of a torque wrench of the invention.
Figure 2:
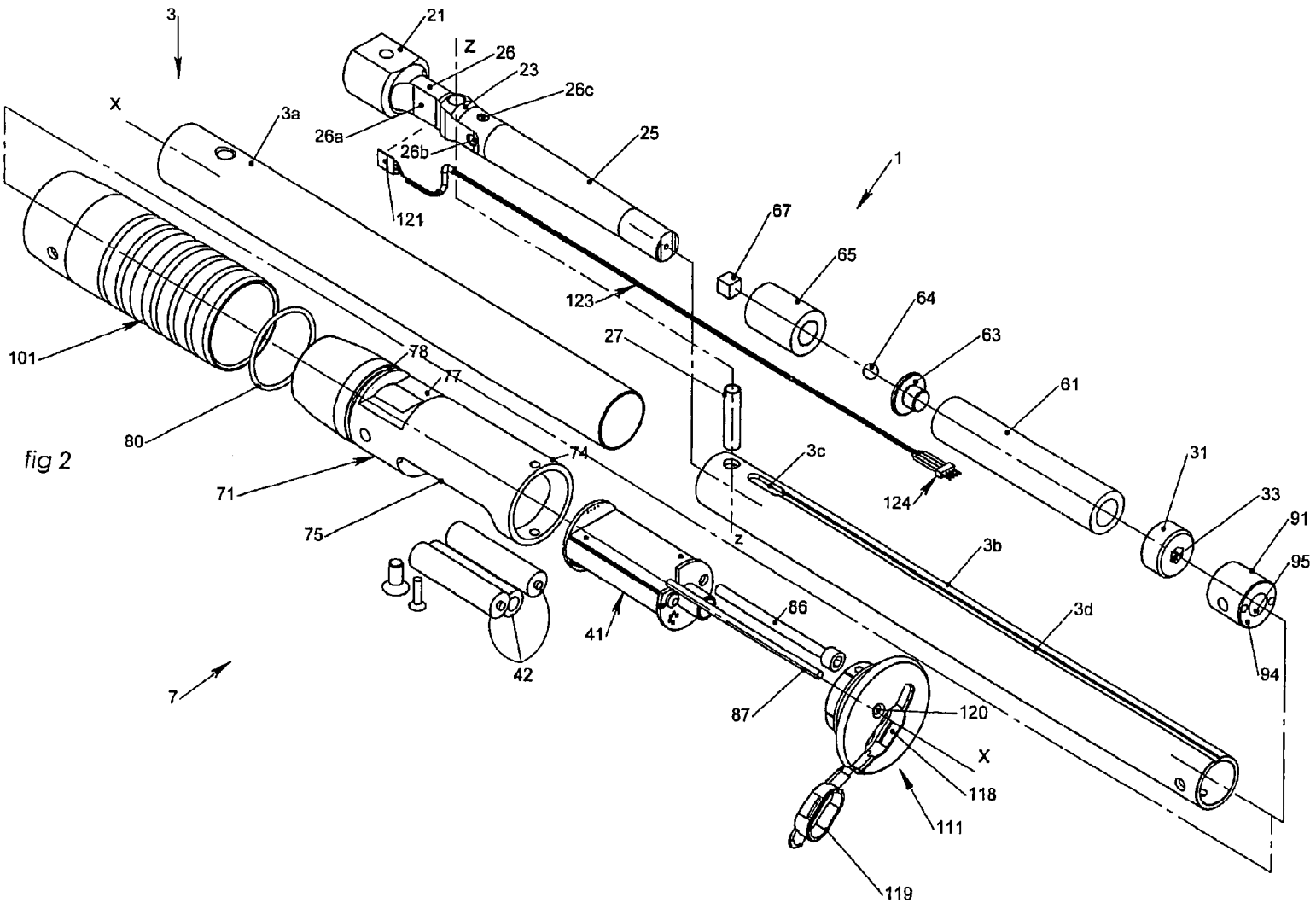
FIG. 2 is an exploded perspective view of the wrench shown in FIG. 1.
Figure 3:
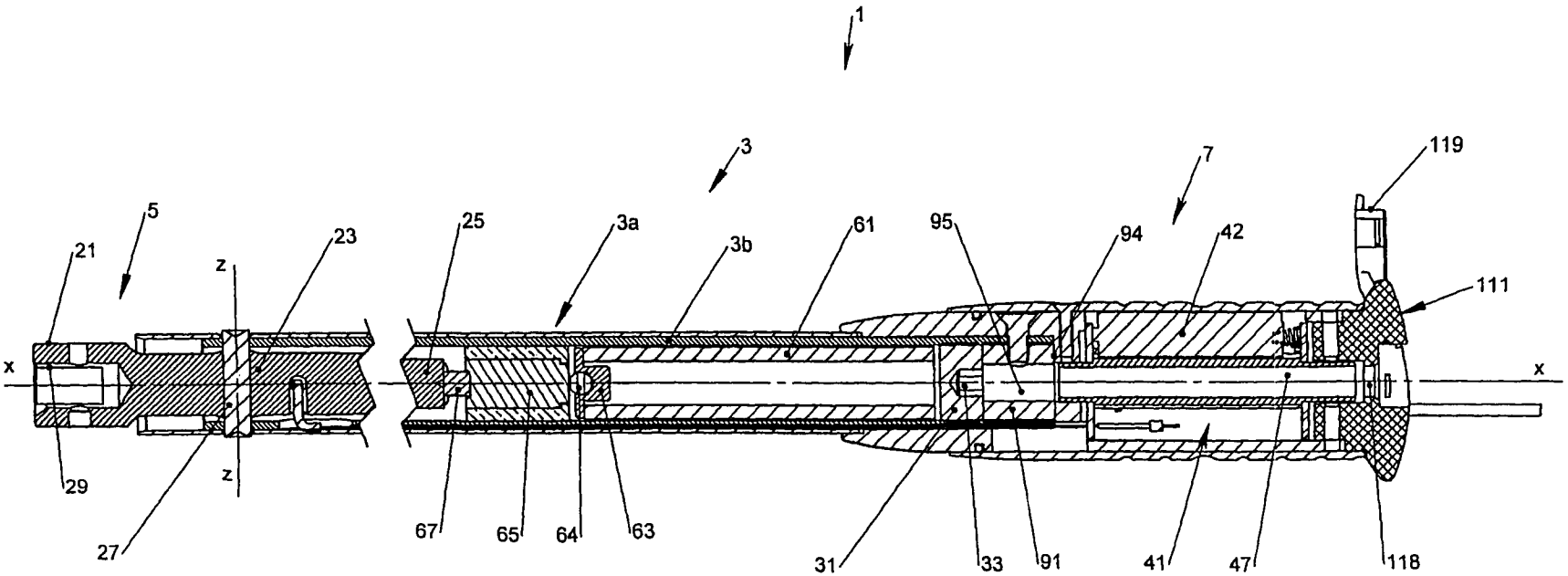
FIG. 3 is a longitudinal section view on line III-III shown in FIG. 1.

FIGS. 1 to 3 show a torque wrench of the invention, the wrench having a longitudinal axis X-X, extending from "back" to "front". The wrench 1 that is shown essentially comprises a tube assembly 3 that is cylindrical in overall shape, and that defines a hollow outer body, a drive element or head 5 in the vicinity of the front of the wrench, and a handle assembly 7 for taking hold of the tool, which handle assembly is situated in the vicinity of the back of the wrench.

The tube assembly 3 is made up of an outer sheath 3*a* defined by a cylindrical sleeve, and of an inner tube 3*b*, the sheath 3*a* being fitted snugly over the tube 3*b* and overlapping the tube 3*b* in the front portion thereof.

The sheath 3*a*, the tube 3*b* and the head 5 are preferably metal parts.

The wrench shown is a torque setting or disengagement torque wrench of the production type, i.e. of the type used in a production workshop for tightening in succession a large number of identical nut and bolt fastener elements to the same predetermined torque. For this type of tool, it is not necessary to re-adjust the torque setting frequently. Naturally, the invention is applicable not only to a production wrench, in particular a torque setting or disengagement production wrench as shown in the figures, but also to a break back torque wrench or to an adjustable torque wrench.

On the wrench shown, the handle assembly 7 is mounted in fixed manner on the tube assembly 3, the proximal end of the handle assembly 7 comprising a stopper 111 provided with a lid 119 for closing off a passageway that is provided towards the inside of the tube assembly 3.

It should be noted that a flexible antenna 87, whose function is described below, projects from the back of the stopper 111.

As also described below with reference to FIGS. 2 and 3, the adjustment members for adjusting the set torque are accessible by means of a tool inserted into the handle assembly 7 and into the tube assembly 3 after the lid 119 has been taken off the stopper 111.

The wrench 1 shown in FIGS. 2 and 3 has a handle assembly 7 including a handle support 71 which is cylindrical in overall shape, which extends coaxially around the axis X-X of the wrench, and in which a support module 41 is mounted and fastened, the handle support 71 being fitted and fastened over the back portion of the tube 3*b*. The handle assembly 7 also includes a sleeve 101 covering the handle support 71 in part, and fastened thereon. The back end of the sheath 3*a* fits with clearance into the front end of the handle support 71.

The drive head 5 is a part that has a front block 21 projecting from the front of the tube assembly 3, a hinge intermediate zone 23, and a back tail 25 fitted with clearance into the tube 3 and mounted so that it is possible for the tail to pivot relative to the tube 3 about an axis Z-Z which is the axis of a pin 27. Between the front block 21 and the hinge intermediate zone 23, the drive head also has an elastically-deformable bar 26 having a rectangular cross-section of dimensions that are constant over its entire length. The elastically-deformable bar 26 has side faces 26*a* that are formed in planes parallel to the axis Z-Z so that they are subjected to the deformations of the elastically-deformable bar 26.

The pin 27 passes diametrically through the hinge intermediate zone 23, the outer sheath 3*a* and the inner tube 3*b* and is secured to the outer sheath 3*a* and to the inner tube 3*b*.

Starting from its front end, the front block 21 has an attachment 29 in which an actuator device (not shown) can be fitted and fastened. Such an actuator device is typically a ratchet head that is reversible by turning it around, and that is provided with a drive square onto which there is fitted a bit in the form of a tightening socket.

It should be noted that, in FIG. 3, the section plane X-Z is assumed to be vertical and the axis X-X is assumed to be horizontal, for reasons of description convenience. The angular position of the wrench shown in this figure corresponds to actuating a bolt (not shown) or a nut (not shown) whose axis is vertical.

In the configuration of use of the wrench as shown in FIG. 3, the following elements are disposed in alignment inside the tube 3*b*, from back to front, up to the back end of the tail 25:

a first externally threaded cylinder 91 having a back end face 94 provided with a through central bore 95, and having an external thread that co-operates with an internal thread formed over at least a back segment of the tube 3*b*. The externally threaded cylinder 91 can thus be screwed-in and defines a back axial abutment;

a second externally threaded cylinder 31 provided with a drive shape 33 facing towards the back end of the tube 3*b*, and having an external thread that co-operates with the internal thread formed over a back segment of the tube 3*b*; the externally threaded cylinder 31 can thus be screwed or unscrewed inside of the tube 3*b* so as to be moved axially, and in the unscrewed position, it comes into back axial abutment against the externally threaded cylinder 91;

a compression spring 61 (shown symbolically in FIGS. 2 and 3) having high stiffness and whose back end bears against the front end of the externally-threaded cylinder 31;

a ball-bearing plate 63 having a ball 64, which plate is secured to the front end of the compression spring 61;

a pusher 65 which is cylindrical in overall shape and has a back face in abutment against the ball 64; the pusher can slide axially while being guided in the tube 3*b*, under drive from the compression spring 61, transmitted by the ball bearing plate 63 and by the ball 64; and a cubic die 67 which bears, at rest, against the end-walls of two recesses, one of which is formed in the back face of the tail 25, and the other one of which is formed in the front face of the pusher 65, said faces being vertical and facing each other.

The assembly formed by the pusher 65 and by the cubic die 67 defines axial bearing means for axially bearing against the drive head 25.

It can be understood that the axial position of the externally threaded cylinder 31 determines the compression of the compression spring 61, and thus determines the axial bearing force applied by the pusher 65 on the tail 25 via the cubic die 67. When the set torque determined by the compression of the compression spring 61 is reached, the cubic die 67 tilts and causes the pusher 65 to move backwards. The tail 25, by pivoting about the pin 27, then comes into contact with the inside surface of the tube assembly 3.

It should be noted that the relatively violent contact, due to mechanical equilibrium being broken, causes the operator to feel a physical sensation that indicates clearly to said operator that the set torque has been reached.

As shown in FIGS. 2 and 3, the handle assembly 7 includes a support module 41 for supporting electrical/electronic means and/or electrical power supply means. The support module 41 comprises a support provided with recesses and/or compartments and end faces suitable for receiving respective electrical power supply means 42, such as "AAA" type batteries and electrical/electronic circuit boards.

As shown in FIG. 2, the proximal end face 74 of the handle support 71 has a tubular segment extending longitudinally and of a shape and size suitable for receiving the support module 41.

An elongate slot 75 is provided axially and at some distance from the proximal end face 74 and over one half of the circumference of the external wall of the handle support 71.

On mounting the support module 41 in the handle support 71, the recesses suitable for receiving the electrical power supply 42 are positioned facing the elongate slot 75 in the handle support 71. This configuration makes it possible for the power supply means 42 to be accessed rapidly.

Once the support module 41 is mounted in the handle support 71, a fastener element 86 holds the support module 41 in position within the handle support 71.

As shown in FIG. 2, measurement means or device 121 for measuring the deformation of the elastically-deformable bar 26 of the drive head 5 are constituted by sensor elements of measurement members, such as resistive extensometers (strain gauges) bonded with adhesive to the faces 26*a* of the elasticity-deformable bar 26. Known measurement devices of some other type can be used without going beyond the ambit of the present invention.

An elongate measurement means 121 carrying extensometers formed and wired directly on it is fastened rigidly and in a manner known per se to a side face 26*a* of the elasticity-deformable bar 26.

The extensometers are connected to a sheet of conductor wires 123. The sheet of conductor wires 123 passes through an internal duct in the back tail 25 of the drive head 5, immediately behind the hinge intermediate zone 23, by passing through an inlet orifice 26*b* in communication with an outlet orifice 26*c*. The sheet of conductor wires 123 then passes through an oblong slot 3*c* situated in a distal portion of the tube 3*b* and continues on its route by being inserted into a longitudinal groove 3*d* provided in the outside surface of the tube 3*b*.

That end of the sheet of conductor wires 123 which is opposite from the plate insulating 121 carrying the extensometers is connected to a connector 124 which is itself connected to one of the electrical circuit boards of the support module 41 via a setback 77 provided in the handle support 71 between the elongated slot 75 and the distal end 72, in that half of the circumference which is opposite from the half-circumference that is provided with the elongated slot 75.

In addition, between the setback 77 and the distal end 72, the handle support 71 is provided with a groove 78 which is suitable for receiving a sealing gasket 80, such as an O-ring gasket.

The stopper 111 shown in FIGS. 2 and 3 is also provided with a passageway 118 extending along the axis X-X of the wrench 61 and in alignment with a central duct 47 of the support of the support module 41.

This arrangement makes it possible for an operator to insert a bit forming screwdriver blade or a wrench in order to access, from the outside, the drive shape 33 of the second externally threaded cylinder 31 by passing through, successively and from the outside, the stopper 111, the support module 41, and the first externally threaded cylinder 91.

The stopper 111 is also provided with a passageway 120 suitable for passing a flexible antenna 87 connected to one of the electrical/electronic circuit boards of the support module 41.

The method of the invention for detecting a break in mechanical equilibrium while manually tightening to torque a fastener element when the torque applied reaches a predetermined set torque can be broken down into the following steps.

Measuring the deformation of the elasticity-deformable bar 26 by using measurement means 121, corresponding to measuring the torque applied to the fastener element.

Electronically processing a signal output from said measuring.

Computationally processing digital data output from said electronic processing, the computational processing being suitable for delivering information relating to detection of a break in mechanical equilibrium.

The measuring means 121 (e.g., resistive sensor elements such as extensometers or strain gauges) are connected, in known manner, in a Wheatstone bridge circuit expressing the deformation of the elasticity-deformable bar 26 in terms of difference in resistance. The power supply means 42, rechargeable or otherwise, situated on the support module 41 constitute the voltage source for powering the bridge circuit.

The support module 41 includes electronic means making it possible to process the signal output from the measuring means (e.g., strain gauges) 121.

The support module 41 also includes computation electronic means making it possible to detect whether or not a break in mechanical equilibrium has occurred. The support module 41 also includes electronic means for transmitting information corresponding to break-in-equilibrium detection and/or to measurement.

Figure 7:
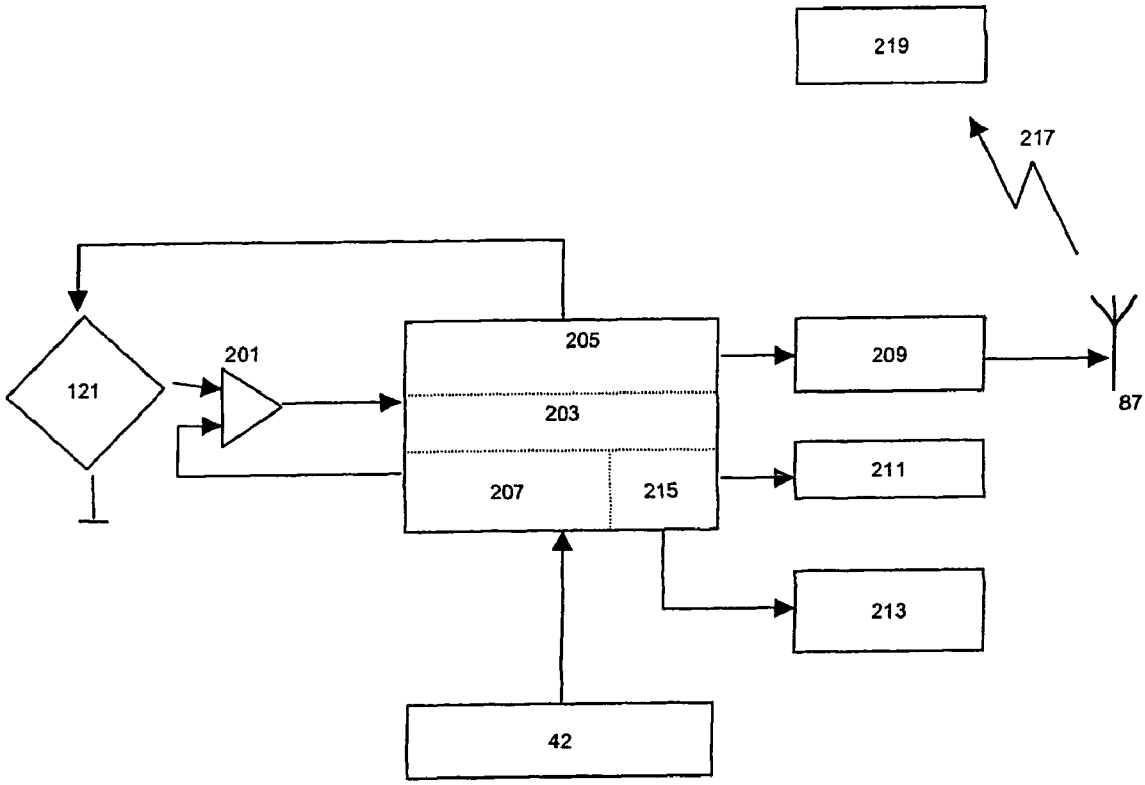
FIG. 7 is a block diagram of the electronics of the wrench of FIG. 1.

As shown in FIG. 7, the electronics diagram comprises measuring means 121 including a bridge gauge circuit connected to one or more amplifier inlets 201. The outlet of the amplifier is connected to an analog-to-digital and digital-to-analog conversion device 203 and to a microcontroller 205. Electronic memory means 207 makes it possible to store one or more items of information. Means 215 makes it possible to perform computation on digital data output from the preceding electronic devices. The electrical power supply for these elements is provided by the power supply means 42.

Information output from the above-described electronic equipment of the wrench can be transmitted remotely 217 to monitoring equipment 219 via a transmission module 209 and via an antenna 87. In other variants, this information can be displayed via a display device such as a screen 211 or via a light-emitting diode (LED) display device 213.

Operation of a tightening sequence is described below.

Figure 4A:
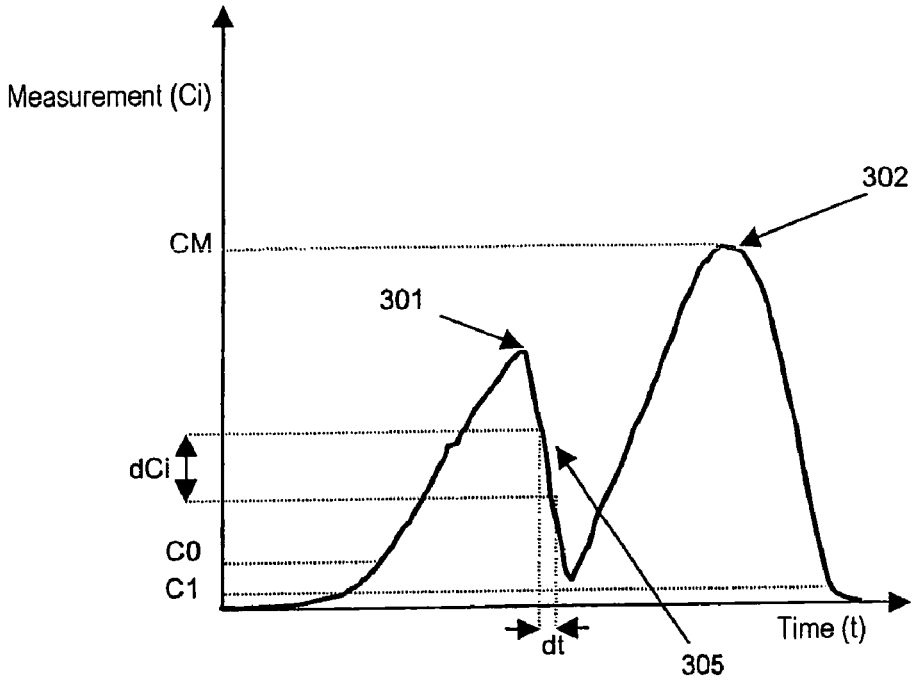
FIG. 4*a* is a graph showing a curve of the measured tightening of the wrench shown in FIG. 1 plotted as function of time.

FIG. 4*a* shows a curve giving measurement of the tightening torque C1 over time t, which curve is characteristic of a wrench operating by breaking mechanical equilibrium. The curve has two consecutive peaks 301 and 302, separated by a trough shape 305. When the set torque determined by the compression of the spring 61 is reached, the wrench undergoes a break in mechanical equilibrium that defines disengagement. The trough shape 305 corresponds to the break in mechanical equilibrium.

Once the mechanical equilibrium has been broken, the operator does not immediately cease to apply the force exerted on the wrench. Over-torque, i.e. torque additional to the set torque is thus applied to the fastener element after the wrench has disengaged.

The peak 302 corresponds to the measurement of the over-torque applied after equilibrium is broken, i.e. the maximum torque CM applied to the fastener element once equilibrium is broken. The peak 301 corresponds to the measurement of the torque applied before equilibrium is broken.

Figure 5:
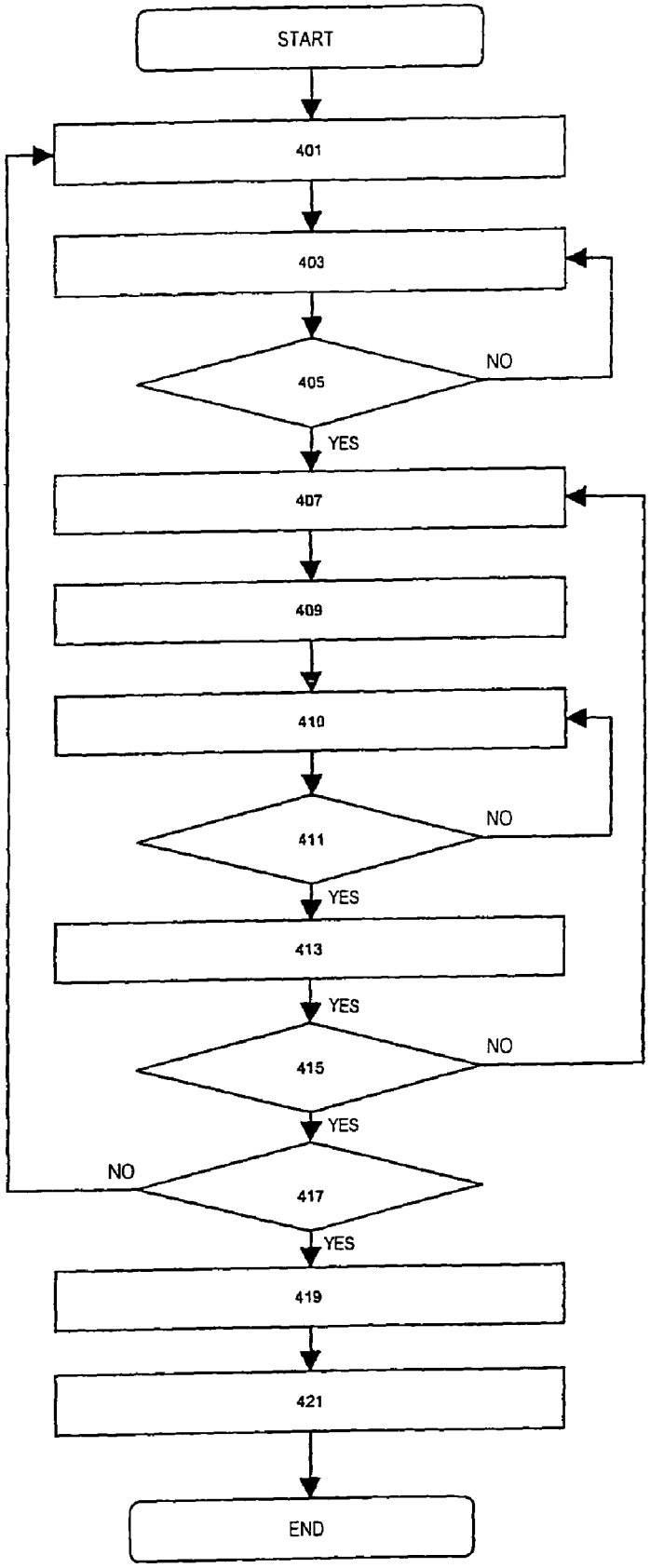
FIG. 5 is a flow chart showing how the wrench shown in FIG. 1 operates.

FIG. 5 is a flow chart of a cycle for tightening to torque.

A stage for parameterizing the tool is performed before any operation. It consists in storing a tool identity number in a memory, in predetermining a first low measurement threshold C0 and a second low measurement threshold C1, and in initializing the number of tightening cycles.

The wrench has a slow-sampling "standby" mode 401. During the slow sampling, a measurement Ci 403 is taken. The measurement Ci 403 is stored and compared 405 with the first predetermined threshold C0.

If the measurement Ci 403 is less than the threshold C0, the "standby" mode is continued with slow sampling.

If the measurement Ci 403 is greater than the threshold C0, the wrench then goes over to "working" mode 407 with fast sampling.

The microcontroller stores in a memory 409 a value for the maximum torque CM equal to the threshold value C0.

During the tightening stage, the microcontroller continuously samples 410 the voltage of the gauges and compares 411 the measured value Ci 403 with the maximum torque value CM. The microcontroller retains the higher value. The value of the maximum measured torque CM is thus stored in a memory 413.

The stored value is then compared 415 with the second predetermined low threshold C1.

If the measured value Ci 403 is greater than the threshold C1, the "working" mode is maintained, with fast sampling.

If the measured value Ci 403 is less than the threshold C1, the microcontroller performs a test for presence of a break in mechanical equilibrium 417.

If the test is negative, the "standby" mode is re-established.

If the presence test is positive, the microcontroller increments the number of cycles 419. A positive presence test conditions transmission 421 of one or more items of information relating to the tightening sequence, such as the presence of a break in mechanical equilibrium and/or the maximum torque value CM, a tool identifier number, or the number of cycles.

Detection of a break in mechanical equilibrium is achieved by analyzing the specific waveform generated by the sudden variation in the resistance of the gauges at the time of disengagement.

The variation in the gauge voltage is in the form of a pulse whose relaxation time is characterized by the natural frequency of the test body. The relaxation time is fixed because it is related to the accuracy of the break in mechanical equilibrium.

Figure 6A:
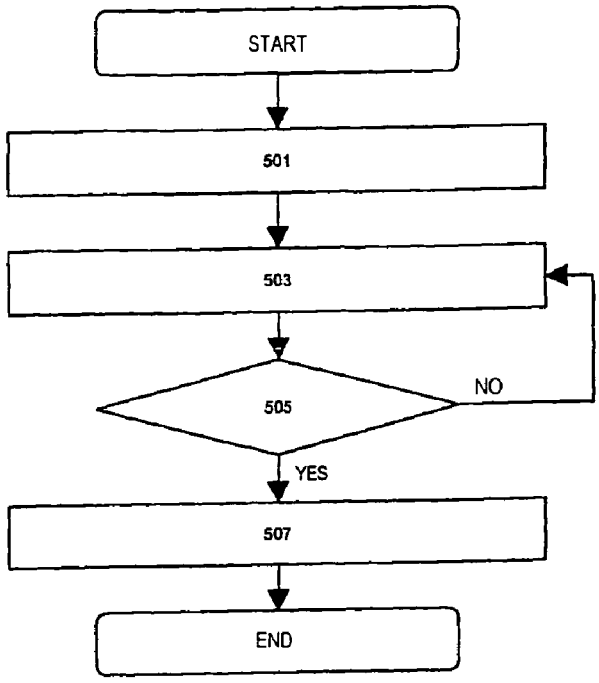
FIG. 6*a* is a flow chart of a first mode of detection of a break in equilibrium of the wrench shown in FIG. 4*a;*

FIG. 6*a* is a flow chart of a first mode of detecting a break in mechanical equilibrium.

The microcontroller samples 501 the output voltage of the measurement means of the gauges. A computer 215 performs a derivation computation dCi/dt of output voltage C1 as a function of time t, and stores 503 the value of this derivative in a memory m.

The computer 215 compares 505 the value of the computed derivative m with a predetermined gradient m0.

If the computed value m is less than the predetermined gradient value m0, the computer 215 performs a new derivative computation on the following sampling.

If the computed value m is greater than the predetermined gradient value m0, the microcontroller delivers information indicating presence of a break in mechanical equilibrium. After digital to analog conversion, a disengagement presence signal can be transmitted 507.

Figure 6B:
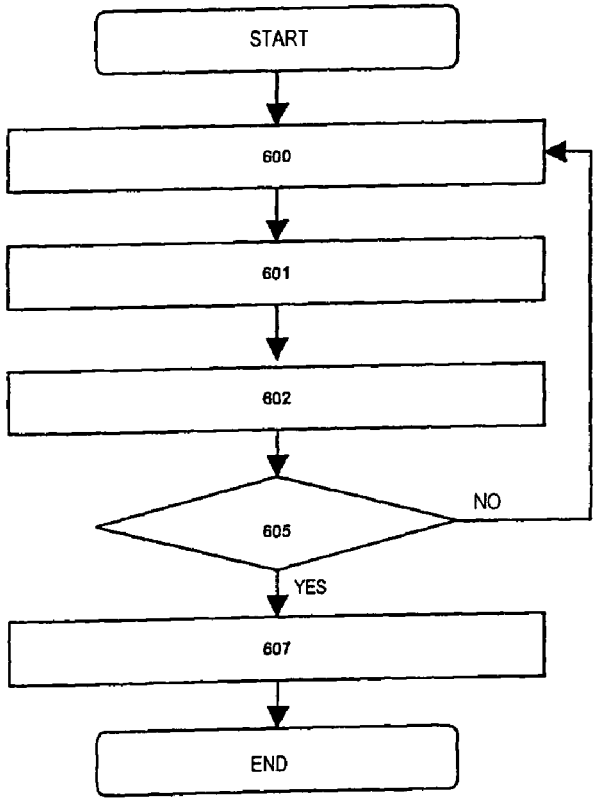
FIG. 6*b* is a flow chart of a second mode of detection of a break in equilibrium of the wrench shown in FIG. 4*b*.

FIG. 6*b* is a flow chart of a second mode of detecting a break in mechanical equilibrium.

The microcontroller samples 600 the output voltage of the measurement means of the gauges. A first curve 601 giving measurement of the tightening torque Ci as a function of time t is stored in a memory.

A second curve 602, identical to the first curve 601 is stored in a memory with a positive and small offset delta-t in time t.

A computer performs a test consisting in identifying the presence of an intersection 305' between the first curve 601 and the second curve 602.

If the answer to this test is positive, a break in mechanical equilibrium 305' is present. The microcontroller delivers information indicating presence of a break in equilibrium. After digital to analog conversion, a disengagement or a break in equilibrium presence signal can be transmitted 607.

If the answer to this test is negative, the microcontroller continues the sampling 600.

Figure 4B:
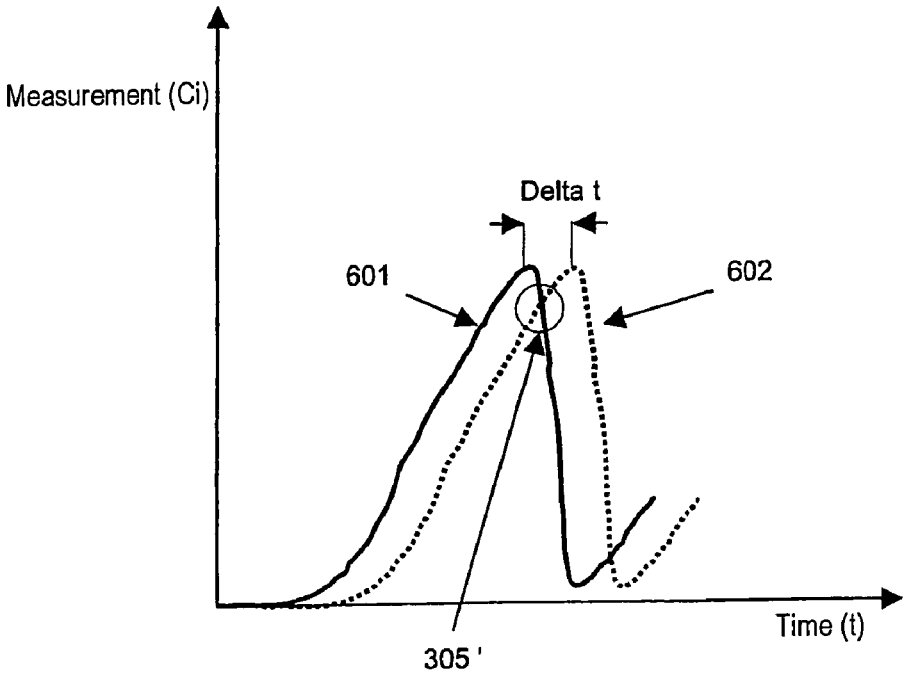
FIG. 4*b* is a graph of a method of calculation for detecting a break in equilibrium of the wrench shown in FIG. 1.

FIG. 4*b* shows a first curve 601 giving measurement of the tightening torque Ci over time t. The first curve 601 has a first peak 301' that is characteristic of a torque-setting or disengagement wrench.

The second curve 602 plotted, has a peak 301" itself offset by an interval delta-t in time.

The intersection 305' of the first curve 601 and of the second curve 602 defines the computed instant of the disengagement or break in mechanical equilibrium.

It can be understood that detection of the break in mechanical equilibrium is essential for counting the number of cycles performed by a production operation and thus for improving traceability.

The transmission can be transmitted via a wireless link 217 to monitoring equipment 219 that is either external to or integrated in the wrench. In which case, the transmission can be transmitted by a radio-frequency link in the Industrial, Scientific and Medical (ISM) band in the vicinity of 896 MHz. The preceding wireless transmission can be replaced with a wired link transmission.

The value of the maximum torque measured after a break in mechanical equilibrium of the wrench can then be displayed on the screen of the monitoring equipment.

The method of detection of the invention makes other steps possible such as, successively, measuring the maximum torque after a break in mechanical equilibrium, transmitting the measurement of the maximum torque after a break in mechanical equilibrium, and displaying the measured value of the maximum torque after a break in mechanical equilibrium.

The steps of the method of detection can be preceded by a step of identifying the tool.

The method of tightening of the invention includes the steps of delivering information corresponding to the measurement of the torque applied to the fastener element, of electronically processing and of delivering information corresponding to the maximum torque applied after a break in mechanical equilibrium, and of transmitting said information corresponding to the measurement of the maximum torque after a break in mechanical equilibrium.

The steps of the method of tightening can be preceded by a step of identifying the tool. The steps can be followed by a step of displaying the measured value of the maximum torque after a break in mechanical equilibrium.

It can be understood that the invention applies in a particularly suitable manner to a torque setting or disengagement torque wrench as described above, but it is also suitable for other dynamometer tools, e.g. a break back torque wrench or a torque screwdriver.

The invention as described above makes it possible to impart improved reliability to the function of detecting a break in mechanical equilibrium without reducing the compactness of a dynamometer tool.

The invention as described above makes it possible to improve traceability of tightening by a dynamometer tool by measuring the over-torque.

What is claimed is:

1. A mechanical dynamometer tool for manually applying torque, said mechanical dynamometer tool comprising:

a drive portion arranged to drive a fastener element;

a mechanical device operably connected to said drive portion so as to be able to deliver torque to said drive portion in a state of mechanical equilibrium of said mechanical device, said mechanical device being releasable from the state of mechanical equilibrium;

a detecting device operable to detect a break in the state of mechanical equilibrium by measuring the torque applied to the fastener element and outputting a signal corresponding to the measurement of the torque applied to the fastener element, and electronically processing the signal corresponding to the measurement of the torque applied to the fastener element, said detecting device comprising:

a measurement device operable to measure the torque applied to the fastener element and output a signal corresponding to the measurement of the torque applied to the fastener element;

an electronic computation device operable to receive the signal corresponding to the measurement of the torque applied to the fastener element output by said measurement device, process the signal, and subsequently detect the break in the state of mechanical equilibrium; and a computation processing device operable to computationally process the signal corresponding to the measurement of the torque applied to the fastener element, and operable to detect the break in the state of mechanical equilibrium by computing an intersection of a first curve representing the measured value of the torque as a function of time, and a second curve being identical to the first curve with a positive offset in time.

2. A mechanical dynamometer tool for manually applying torque, said mechanical dynamometer tool comprising:

a drive portion arranged to drive a fastener element;

a mechanical device operably connected to said drive portion so as to be able to deliver torque to said drive portion in a state of mechanical equilibrium of said mechanical device, said mechanical device being releasable from the state of mechanical equilibrium;

a biasing device operable to place said mechanical device in the state of mechanical equilibrium, said biasing device including a compression spring operable to deliver an axial bearing force, according to a compression force of said compression spring, to said mechanical device, wherein a predetermined torque is set according to the axial bearing force applied by said compression spring; and a detecting device arranged inside said mechanical dynamometer tool and operable to detect a break in the state of mechanical equilibrium by measuring the torque applied to the fastener element and outputting a signal corresponding to the measurement of the torque applied to the fastener element, and electronically processing the signal corresponding to the measurement of the torque applied to the fastener element, said detecting device comprising:

a measurement device operable to measure the torque applied to the fastener element and output a signal corresponding to the measurement of the torque applied to the fastener element; and an electronic computation device operable to receive the signal corresponding to the measurement of the torque applied to the fastener element output by said measurement device, process the signal, and subsequently detect the break in the state of mechanical equilibrium.

3. A mechanical dynamometer tool for manually applying torque, said mechanical dynamometer tool comprising:

a drive portion arranged to drive a fastener element;

a mechanical device operably connected to said drive portion so as to be able to deliver torque to said drive portion in a state of mechanical equilibrium of said mechanical device, said mechanical device being releasable from the state of mechanical equilibrium;

a biasing device operable to place said mechanical device in the state of mechanical equilibrium, said biasing device including a compression spring operable to deliver an axial bearing force, according to a compression force of said compression spring, to said mechanical device, wherein a predetermined torque is set according to the axial bearing force applied by said compression spring;

a detecting device operable to detect a break in the state of mechanical equilibrium by measuring the torque applied to the fastener element and outputting a signal corresponding to the measurement of the torque applied to the fastener element, and electronically processing the signal corresponding to the measurement of the torque applied to the fastener element, said detecting device comprising:

a measurement device operable to measure the torque applied to the fastener element and output a signal corresponding to the measurement of the torque applied to the fastener element; and an electronic computation device operable to receive the signal corresponding to the measurement of the torque applied to the fastener element output by said measurement device, process the signal, and subsequently detect the break in the state of mechanical equilibrium; and a transmission device operable to transmit a measurement of a maximum tightening torque applied to the fastener element to a station external to said mechanical dynamometer tool wherein the station is operable to display the measurement of the maximum tightening torque.

4. The mechanical dynamometer tool according to claim 3, wherein said measurement device includes a resistive sensor, and the measurement of the maximum tightening torque applied to the fastener element is transmitted by radio.

5. A mechanical dynamometer tool for manually applying torque, said mechanical dynamometer tool comprising:

a drive portion arranged to drive a fastener element;

a mechanical device operably connected to said drive portion so as to be able to deliver torque to said drive portion in a state of mechanical equilibrium of said mechanical device, said mechanical device being releasable from the state of mechanical equilibrium;

a biasing device operable to place said mechanical device in the state of mechanical equilibrium, said biasing device including a compression spring operable to deliver an axial bearing force, according to a compression force of said compression spring, to said mechanical device, wherein a predetermined torque is set according to the axial bearing force applied by said compression spring; and a detecting device operable to detect a break in the state of mechanical equilibrium by measuring the torque applied to the fastener element and outputting a signal corresponding to the measurement of the torque applied to the fastener element, and electronically processing the signal corresponding to the measurement of the torque applied to the fastener element, said detecting device comprising:

a measurement device operable to measure the torque applied to the fastener element and output a signal corresponding to the measurement of the torque applied to the fastener element; and an electronic computation device operable to receive the signal corresponding to the measurement of the torque applied to the fastener element output by said measurement device, process the signal, and subsequently detect the break in the state of mechanical equilibrium, wherein:

said measurement device comprises a plurality of sensor elements which measure a value corresponding to the torque applied to the fastener element; and said electronic computation device is integrated into and internally arranged within said mechanical dynamometer tool, is operable to deliver information corresponding to the measurement of a maximum torque applied to the fastener element after the state of mechanical equilibrium is broken, and is operable to transmit to a reception unit the information corresponding to the measurement of the maximum torque applied to the fastener element after the state of mechanical equilibrium is broken.

6. A mechanical dynamometer tool for manually applying torque, said mechanical dynamometer tool comprising:

a drive portion arranged to drive a fastener element;

a mechanical device operably connected to said drive portion so as to be able to deliver torque to said drive portion in a state of mechanical equilibrium of said mechanical device, said mechanical device being releasable from the state of mechanical equilibrium;

a biasing device operable to place said mechanical device in the state of mechanical equilibrium, said biasing device including a compression spring operable to deliver an axial bearing force, according to a compression force of said compression spring, to said mechanical device, wherein a predetermined torque is set according to the axial bearing force applied by said compression spring; and a detecting device operable to detect a break in the state of mechanical equilibrium by measuring the torque applied to the fastener element and outputting a signal corresponding to the measurement of the torque applied to the fastener element, and electronically processing the signal corresponding to the measurement of the torque applied to the fastener element, said detecting device comprising:

a measurement device operable to measure the torque applied to the fastener element and output a signal corresponding to the measurement of the torque applied to the fastener element; and an electronic computation device operable to receive the signal corresponding to the measurement of the torque applied to the fastener element output by said measurement device, process the signal, and subsequently detect the break in the state of mechanical equilibrium, wherein:

said measurement device comprises a plurality of sensor elements which measure a value corresponding to the torque applied to the fastener element;

said electronic computation device is integrated into said mechanical dynamometer tool, is operable to deliver information corresponding to the measurement of a maximum torque applied to the fastener element after the state of mechanical equilibrium is broken, and is operable to transmit to a reception unit the information corresponding to the measurement of the maximum torque applied to the fastener element after the state of mechanical equilibrium is broken; and the reception unit is an external station that is external to said mechanical dynamometer tool, and is operable to display a value of the measurement of the maximum tightening torque applied to the fastener element.

* * * * *